US008042432B2

(12) United States Patent
Hunter et al.

(10) Patent No.: US 8,042,432 B2
(45) Date of Patent: Oct. 25, 2011

(54) OILFIELD TUBULAR TORQUE WRENCH

(75) Inventors: Douglas A. Hunter, Calgary (CA); Martin H. Thieme, Cochrane (CA); Friedhold Brost, Sidney (CA)

(73) Assignee: Canrig Drilling Technology Ltd., Houston, TX (US)

( * ) Notice: Subject to any disclaimer, the term of this patent is extended or adjusted under 35 U.S.C. 154(b) by 0 days.

(21) Appl. No.: 12/391,935

(22) Filed: Feb. 24, 2009

(65) Prior Publication Data

US 2009/0211405 A1 Aug. 27, 2009

Related U.S. Application Data

(63) Continuation of application No. PCT/CA2006/001387, filed on Aug. 24, 2006.

(51) Int. Cl.
*B25B 13/50* (2006.01)
*E21B 19/16* (2006.01)

(52) U.S. Cl. ..... 81/57.16; 81/57.34

(58) Field of Classification Search ..... 81/57.16, 81/57.2, 57.33, 57.34
See application file for complete search history.

(56) References Cited

U.S. PATENT DOCUMENTS

| | | | |
|---|---|---|---|
| 3,693,727 | A | 9/1972 | Bell |
| 3,768,573 | A | 10/1973 | Jennings |
| 3,799,009 | A | 3/1974 | Guier |
| 3,881,375 | A | 5/1975 | Kelly |
| 3,882,377 | A | 5/1975 | Kelly |
| 3,961,399 | A | 6/1976 | Boyadjieff |

(Continued)

FOREIGN PATENT DOCUMENTS

| | | |
|---|---|---|
| CA | 1014705 | 8/1977 |

(Continued)

OTHER PUBLICATIONS

HiPer™ Control System, http://www.weatherford.com/weatherford/groups/public/documents/general/wft008924.pdf, 2005.

(Continued)

*Primary Examiner* — David B Thomas
(74) *Attorney, Agent, or Firm* — Haynes and Boone, LLP

(57) ABSTRACT

An oilfield tubular torque wrench and a tong therefore is described. In one aspect, a torque wrench is described including an upper tong including a recess for accepting an oilfield tubular positioned along an axis passing through the recess; a lower tong including a recess positioned below the recess of the upper tong so that the axis passes therethrough; pipe gripping dies in the recesses of the upper tong and the lower tong drivable toward and away from the axis; a swivel bearing between the upper tong and the lower tong permitting the upper tong and the lower tong to swivel relative thereto while the recesses remain positioned with the axis passing therethrough, the swivel bearing including a first partial ring mounted to one of the upper tong and the lower tong and a second partial ring mounted on the other of the upper tong and lower tong, the second partial ring being interengaged at a bearing surface to ride along a length of a bearing surface of the first partial ring; and a retainer ring positioned adjacent one of the first partial ring and the second partial ring to act against lateral disengagement of the second partial ring from the first partial ring. In another aspect, dissimilar materials are selected for the first ring and the second ring to avoid galling. In another aspect a tong with adjustable dies is described.

28 Claims, 6 Drawing Sheets

U.S. PATENT DOCUMENTS

| | | | | |
|---|---|---|---|---|
| 4,023,449 | A | | 5/1977 | Boyadjieff |
| 4,082,017 | A | * | 4/1978 | Eckel ..... 81/57.16 |
| 4,091,451 | A | | 5/1978 | Weiner et al. |
| 4,176,436 | A | | 12/1979 | McCombs et al. |
| 4,192,206 | A | | 3/1980 | Schulze-Beckinghausen |
| 4,202,225 | A | | 5/1980 | Sheldon et al. |
| 4,208,775 | A | | 6/1980 | McCombs et al. |
| 4,210,017 | A | | 7/1980 | Motsinger |
| 4,235,566 | A | | 11/1980 | Beeman et al. |
| 4,365,402 | A | | 12/1982 | McCombs et al. |
| 4,386,883 | A | | 6/1983 | Hogan et al. |
| 4,403,898 | A | | 9/1983 | Thompson |
| 4,437,363 | A | | 3/1984 | Haynes |
| 4,444,273 | A | | 4/1984 | Ruby |
| 4,444,421 | A | | 4/1984 | Ahlstone |
| 4,470,740 | A | | 9/1984 | Frias |
| 4,474,520 | A | | 10/1984 | Buckner et al. |
| 4,475,607 | A | * | 10/1984 | Haney ..... 188/67 |
| 4,494,899 | A | | 1/1985 | Hoang et al. |
| 4,495,840 | A | | 1/1985 | Freitag et al. |
| 4,515,045 | A | | 5/1985 | Gnatchenko et al. |
| 4,552,041 | A | | 11/1985 | Coyle, Sr. |
| 4,567,779 | A | | 2/1986 | Byrne |
| 4,567,952 | A | | 2/1986 | Lemaire et al. |
| 4,574,664 | A | | 3/1986 | Curry |
| 4,592,125 | A | | 6/1986 | Skene |
| 4,603,464 | A | | 8/1986 | Smith, Jr. et al. |
| 4,688,453 | A | | 8/1987 | Schulze-Beckinghausen |
| 4,696,207 | A | | 9/1987 | Boyadjieff |
| 4,700,787 | A | | 10/1987 | Buck et al. |
| 4,709,766 | A | | 12/1987 | Boyadjieff |
| 4,725,179 | A | | 2/1988 | Woolslayer et al. |
| 4,727,781 | A | * | 3/1988 | Yuehui et al. ..... 81/57.34 |
| 4,730,254 | A | | 3/1988 | Voden, Jr. |
| 4,738,145 | A | | 4/1988 | Vincent et al. |
| 4,739,681 | A | | 4/1988 | Pietras |
| 4,765,401 | A | | 8/1988 | Boyadjieff |
| 4,808,064 | A | | 2/1989 | Bartholet |
| 4,843,945 | A | | 7/1989 | Dinsdale |
| 4,924,954 | A | | 5/1990 | Mead |
| 4,941,362 | A | | 7/1990 | Tambini |
| 4,981,180 | A | | 1/1991 | Price |
| 5,036,927 | A | | 8/1991 | Willis |
| 5,050,691 | A | | 9/1991 | Moses |
| 5,099,725 | A | | 3/1992 | Bouligny, Jr. et al. |
| 5,172,613 | A | | 12/1992 | Wesch, Jr. |
| 5,291,808 | A | | 3/1994 | Buck |
| 5,297,833 | A | | 3/1994 | Willis et al. |
| 5,402,688 | A | | 4/1995 | Okada et al. |
| 5,435,213 | A | | 7/1995 | Buck |
| 5,509,316 | A | | 4/1996 | Hall |
| 5,855,002 | A | | 12/1998 | Armstrong |
| 6,003,412 | A | | 12/1999 | Dlask et al. |
| 6,012,360 | A | | 1/2000 | Concha |
| RE36,631 | E | | 3/2000 | Tanabe et al. |
| 6,047,775 | A | | 4/2000 | Mock |
| 6,070,500 | A | | 6/2000 | Dlask et al. |
| 6,079,925 | A | | 6/2000 | Morgan et al. |
| 6,082,224 | A | | 7/2000 | McDaniels et al. |
| 6,082,225 | A | | 7/2000 | Richardson |
| 6,206,096 | B1 | | 3/2001 | Belik |
| 6,213,216 | B1 | | 4/2001 | Rogers |
| 6,237,445 | B1 | | 5/2001 | Wesch, Jr. |
| 6,263,763 | B1 | | 7/2001 | Feigel, Jr. et al. |
| 6,311,789 | B1 | | 11/2001 | Saxman |
| 6,314,411 | B1 | | 11/2001 | Armstrong |
| 6,374,706 | B1 | | 4/2002 | Newman |
| 6,385,837 | B1 | | 5/2002 | Murakami et al. |
| 6,505,531 | B2 | | 1/2003 | Stogner |
| 6,532,648 | B2 | | 3/2003 | Murakami et al. |
| 6,533,519 | B1 | | 3/2003 | Tolmon et al. |
| 6,634,259 | B2 | | 10/2003 | Castille |
| 6,715,569 | B1 | | 4/2004 | Rogers |
| 6,752,044 | B2 | | 6/2004 | Hawkins, III |
| 6,814,149 | B2 | | 11/2004 | Liess et al. |
| 6,896,055 | B2 | | 5/2005 | Koithan |
| 6,966,385 | B2 | | 11/2005 | Hemphill et al. |
| 6,971,283 | B2 | * | 12/2005 | Belik ..... 81/57.33 |
| 7,000,502 | B2 | | 2/2006 | Belik |
| 7,028,585 | B2 | | 4/2006 | Pietras et al. |
| 7,036,396 | B2 | | 5/2006 | Moe et al. |
| 7,062,991 | B1 | | 6/2006 | West et al. |
| 7,100,698 | B2 | | 9/2006 | Kracik et al. |
| 7,117,938 | B2 | | 10/2006 | Hamilton et al. |
| 7,178,612 | B2 | | 2/2007 | Belik |
| 7,191,840 | B2 | | 3/2007 | Pietras et al. |
| 7,249,639 | B2 | | 7/2007 | Belik |
| 7,264,050 | B2 | | 9/2007 | Koithan et al. |
| 7,322,406 | B2 | | 1/2008 | Wiggins et al. |
| 7,435,924 | B2 | | 10/2008 | Schmitt-Walter et al. |
| 7,455,128 | B2 | | 11/2008 | Belik |
| 2004/0051326 | A1 | * | 3/2004 | Belik ..... 294/88 |
| 2004/0144547 | A1 | | 7/2004 | Koithan et al. |
| 2004/0237726 | A1 | | 12/2004 | Schulze-Beckinghausen |
| 2005/0076744 | A1 | | 4/2005 | Pietras et al. |
| 2005/0077743 | A1 | | 4/2005 | Pietras et al. |
| 2005/0092143 | A1 | | 5/2005 | Lehnert et al. |
| 2005/0096846 | A1 | | 5/2005 | Koithan et al. |
| 2005/0188794 | A1 | | 9/2005 | Schulze-Beckinghausen |
| 2006/0179980 | A1 | | 8/2006 | Pietras et al. |
| 2007/0068669 | A1 | * | 3/2007 | Lesko ..... 166/77.51 |
| 2007/0074606 | A1 | | 4/2007 | Halse |

FOREIGN PATENT DOCUMENTS

| | | |
|---|---|---|
| CA | 1062237 | 9/1979 |
| CA | 1164443 | 3/1984 |
| CA | 1185228 | 4/1985 |
| CA | 1194855 | 10/1985 |
| CA | 1195241 | 10/1985 |
| CA | 1250569 | 2/1989 |
| CA | 1254194 | 5/1989 |
| CA | 1257881 | 7/1989 |
| CA | 1265124 | 1/1990 |
| CA | 2018826 | 4/1991 |
| CA | 2048381 | 2/1993 |
| CA | 2113160 | 2/1993 |
| CA | 2113161 | 2/1993 |
| CA | 2131537 | 9/1993 |
| CA | 1327195 | 2/1994 |
| CA | 2148346 | 5/1994 |
| CA | 2115810 | 4/1995 |
| CA | 2195128 | 4/1995 |
| CA | 2224638 | 6/1999 |
| CA | 2325875 | 8/1999 |
| CA | 2306714 | 11/2000 |
| CA | 2389449 | 5/2001 |
| CA | 2390191 | 5/2001 |
| CA | 2451263 | 5/2004 |
| CA | 2484053 | 4/2005 |
| WO | WO 00/52297 | 9/2000 |
| WO | WO 01/51764 | 7/2001 |
| WO | WO 01/79652 | 10/2001 |
| WO | WO 2008/022425 | 2/2008 |
| WO | WO 2008/022427 | 2/2008 |
| WO | WO 2008/028302 | 3/2008 |
| WO | WO 2008/034262 | 3/2008 |

OTHER PUBLICATIONS

JAMPro™ Net, http://www.weatherford.com/weatherford/groups/public/documents/general/wft008926.pdf, 2005.

Drillfloor Equipment, http://www.akersolutions.com/Internet/IndustriesAndServices/OilAndGas/Drilling+Equipment/Drillfloor Equipment.htm, 2008.

Robot Roughneck Ready to Rule, http://www.akersolutions.com/Internet/MediaCentre/Featurestories/OilandGas/RobotRoughneckreadytorule.htm, 2008.

Mechanized Rig Systems, http://www.weatherford.com/weatherford/groups/public/documents/general/wft000668.pdf.

* cited by examiner

OILFIELD TUBULAR TORQUE WRENCH

CROSS-REFERENCE TO RELATED APPLICATION

This is a continuation application of co-pending PCT/CA2006/001387, filed Aug. 24, 2006, the contents of which is hereby incorporated herein in its entirety by express reference thereto.

FIELD

The present invention generally relates to oilfield tubular torque wrenches, which are sometimes termed power tongs or iron rough necks. These devices are used in handling make up or breakout of wellbore tubulars, including for example drill pipe, drill collars, casing, stabilizers and a drill bits. Torque wrenches often include tongs and dies for gripping portions of the tubular string.

BACKGROUND

Various types of torque wrenches have been employed when making up or breaking out drill pipe joints, drill collars, casing and the like in oil well drilling and oilfield tubular running operations. Generally torque wrenches include upper and lower tongs that sequentially grip and release upper and lower tubulars with the upper and lower tongs being moved in a swivelling or scissoring manner to torque as by threading or unthreading a threaded connection between the tubulars. Power operated tongs have been provided for this purpose.

In some torque wrenches, an upper tong and a lower tong are swiveled with respect to each other by a torqueing cylinder which can be extended or retracted to break out or make up the tubulars as may be required. A pipe biting or gripping system on each tong utilizes moveable die heads that include pipe gripping dies. The die heads may be moveable by various means including, for example, hydraulic rams that extend to move the die heads into gripping or biting engagement with the pipe.

SUMMARY

In accordance with a broad aspect of the present invention, there is provided an oilfield tubular torque wrench tong comprising: a recess for accepting an oilfield tubular along an axis passing through the recess; pipe gripping dies mounted in the recess, each pipe gripping die including a gripping face defining a plane thereon and the pipe gripping dies together defining an arcuate pipe gripping surface including an arc tangentially contacting the planes of the pipe gripping faces, at least one of the pipe gripping dies being automatically adjustable to vary a radius of the arc of the arcuate pipe gripping surface.

In accordance with another broad aspect of the present invention, there is provided an oilfield tubular torque wrench comprising: an upper tong including a recess for accepting an oilfield tubular positioned along an axis passing through the recess; a lower tong including a recess positioned below the recess of the upper tong so that the axis passes therethrough; pipe gripping dies in the recesses of the upper tong and the lower tong drivable toward and away from the axis; a swivel bearing between the upper tong and the lower tong permitting the upper tong and the lower tong to swivel relative thereto while the recesses remain positioned with the axis passing therethrough, the swivel bearing including a first partial ring mounted to one of the upper tong and the lower tong and a second partial ring mounted on the other of the upper tong and lower tong, the second partial ring being interengaged at a bearing surface to ride along a length of a bearing surface of the first partial ring and the bearing surface of the second ring being formed of a material different than the material of the bearing surface of the first partial ring.

In accordance with another broad aspect, an oilfield tubular torque wrench is provided comprising: an upper tong including a recess for accepting an oilfield tubular positioned along an axis passing through the recess; a lower tong including a recess positioned below the recess of the upper tong so that the axis passes therethrough; pipe gripping dies in the recesses of the upper tong and the lower tong drivable toward and away from the axis; a swivel bearing between the upper tong and the lower tong permitting the upper tong and the lower tong to swivel relative thereto while the recesses remain positioned with the axis passing therethrough, the swivel bearing including a first partial ring mounted to one of the upper tong and the lower tong and a second partial ring mounted on the other of the upper tong and lower tong, the second partial ring being interengaged at a bearing surface to ride along a length of a bearing surface of the first partial ring; and a retainer ring positioned adjacent one of the first partial ring and the second partial ring to act against lateral disengagement of the second partial ring from the first partial ring.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION OF VARIOUS EMBODIMENTS

Figure 1A:
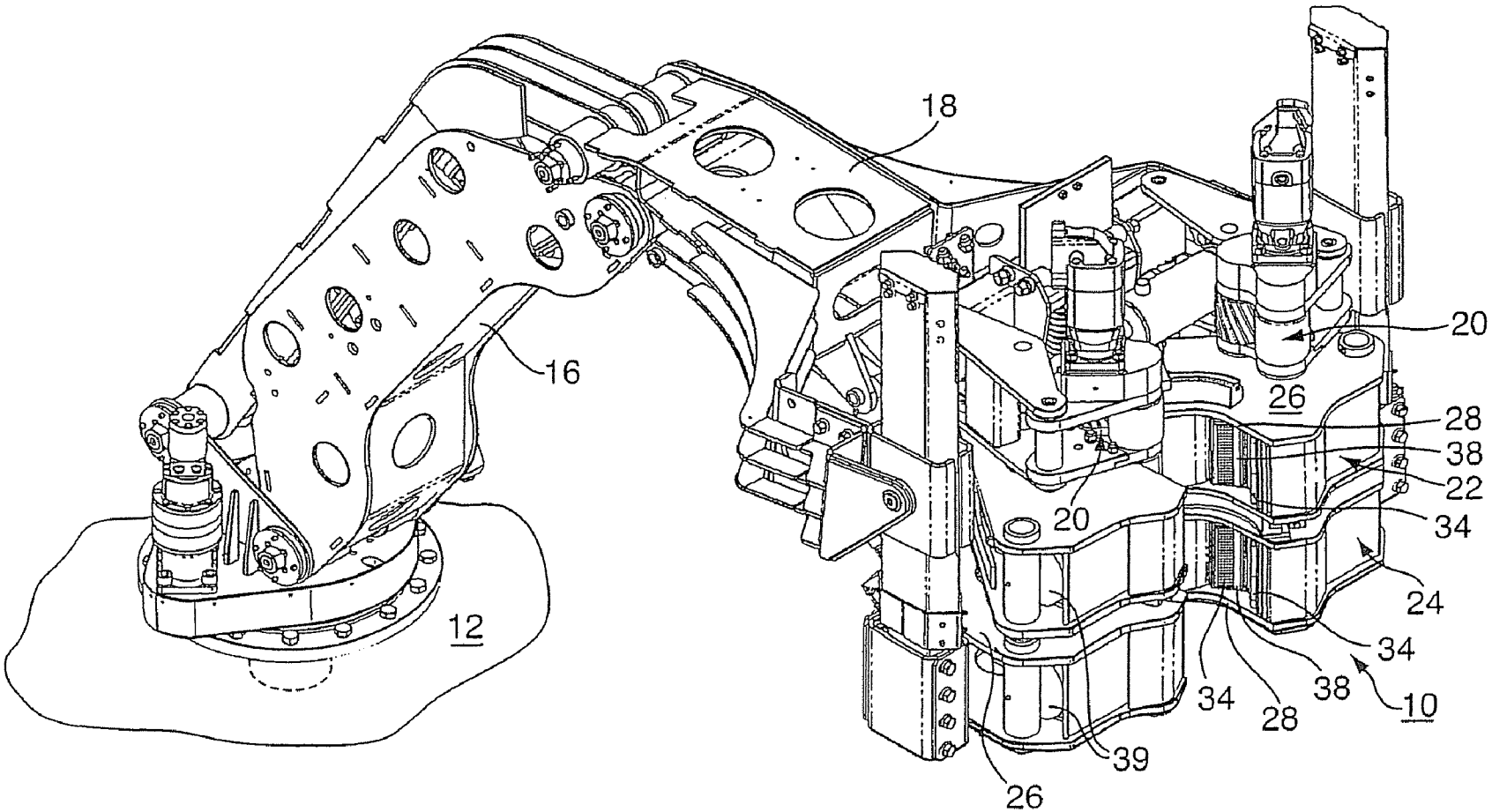
FIGS. 1A and 1B are perspective and top plan views, respectively, of a torque wrench mounted on a mounting structure.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention generally relates to drill pipe torque wrench tongs used in making up or breaking apart oilfield tubulars and includes dies for gripping a pipe to be handled.

To facilitate understanding of drill pipe torque wrenches, it is noted that such devices often include hydraulically or pneumatically powered upper and lower tongs that are swivelly connected for a scissoring action. Each of the tongs includes dies that act to bite into or grip a pipe to be handled.

Referring now specifically to FIGS. 1A to 2B of the drawings, one embodiment of a power actuated drill pipe torque wrench of the present invention is generally designated by numeral 10 and illustrated in association with a drill rig floor 12, a supporting member including in this embodiment an arm 16 which includes a laterally extending support member 18 for the wrench. The wrench is associated with a spinner generally designated by numeral 20, which is located above the wrench for spinning the pipe. While the invention is hereafter described utilizing hydraulically actuated power cylinders and a hydraulic circuit therefor, it will be readily appreciated and understood by those skilled in the art that any one or all of the power cylinders of this invention can alternately be pneumatic and a conventional pneumatic circuit may be used in conjunction therewith. Alternately, screw drives or other drivers may be used.

The wrench 10 includes an upper tong 22 and a lower tong 24 each of which may be substantially identical and which each include a horizontally disposed body 26 with a recess 28 in an edge thereof to receive oilfield tubulars to be handled thereby including for example joints of drill pipe, drill collars, casing, wellbore liners, bits and the like.

In operation, upper tong 22 may act on an upper tubular 30 and lower long 24 may act on a lower tubular 31. The tubulars 30, 31 are shown in phantom to facilitate illustration. With the upper tong 22 gripping an upper tubular and the lower tong gripping a lower tubular, tongs 22, 24 may be swiveled relative to each other, which often includes holding one of the tongs stationary, while the other tong swivels relative thereto, to either torque up or break out a threaded connection between the tubulars. Recesses 28 may be formed so that tubulars 30, 31 extend generally along an axis x through the recesses and during swiveling of the tongs, the recesses remain positioned one above the other.

Each tong includes a plurality of pipe gripping dies 34 supported by body in recess 28. The pipe gripping dies include pipe gripping teeth mounted thereon. In the illustrated embodiment, dies 34 are mounted on die heads 38 that are moveable, as by hydraulics 39, pneumatics, screw drives, etc., toward and away from axis x. As such, dies 34 may be extended into a gripping position in recess 28 or retracted from a gripping position, as desired. In the illustrated embodiment, the die heads are positioned in recess 28 to act substantially diametrically opposite each other to act to grip a tubular therebetween.

Each die head 38 may have an angular or curved surface on which its dies 34 are mounted in spaced apart relation so that the dies are arranged along an arcuate path to generally follow the outer surface of a tubular 30 to be gripped, the outer surface of which is also generally arcuate. The spaced, angular positioning may enable the dies 34 to engage spaced points on the circumference of the tubular.

Figure 1B:
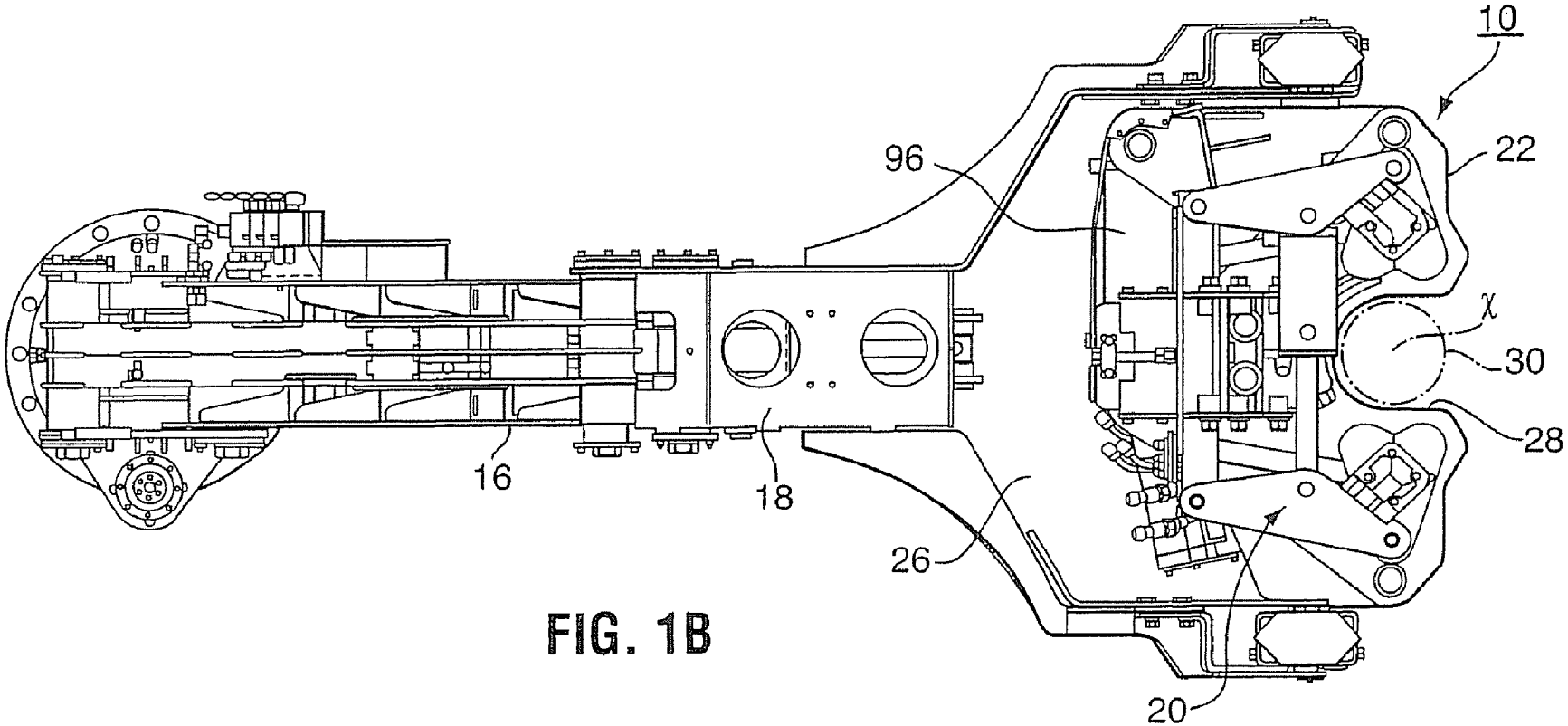
Figure 2A:
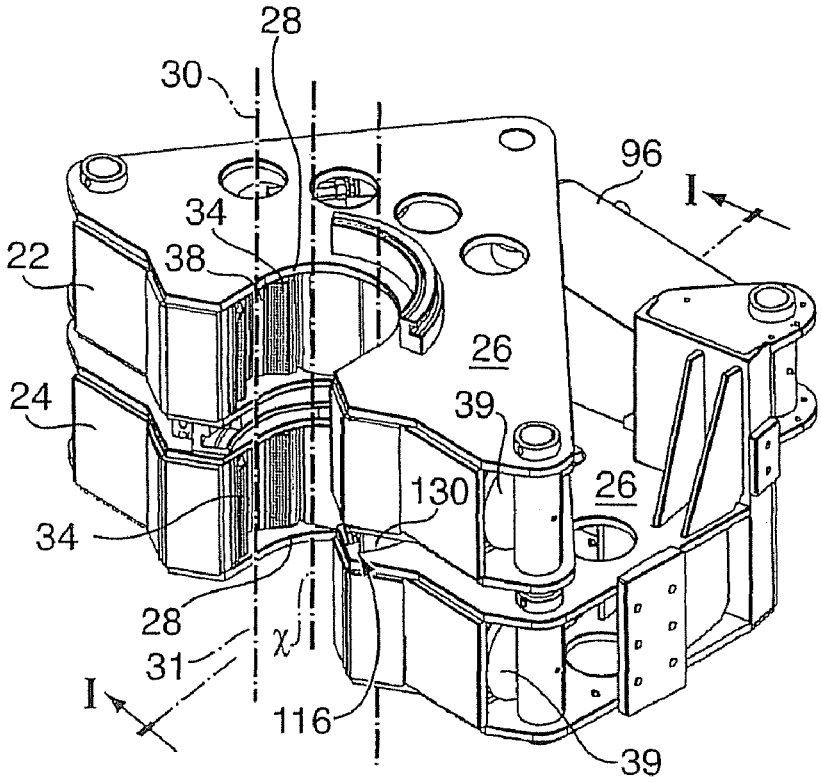
FIGS. 2A and 2B are perspective views of a torque wrench according to one embodiment of the invention with FIG. 2A showing the torque wrench tongs in a neutral position and FIG. 2B showing the torque wrench tongs in a connection make up start position.
Figure 2B:
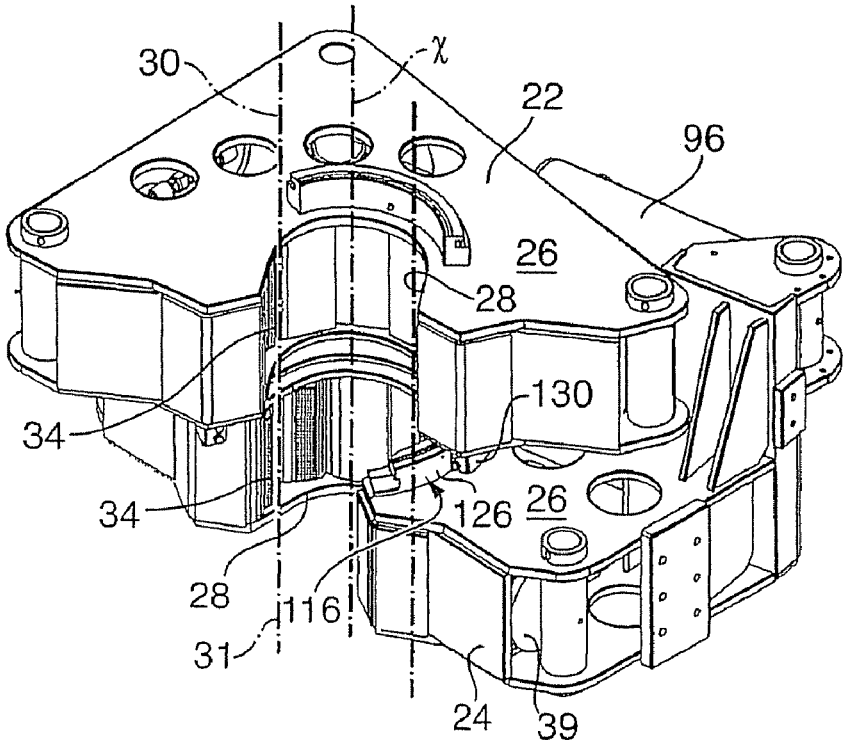
Figure 3:
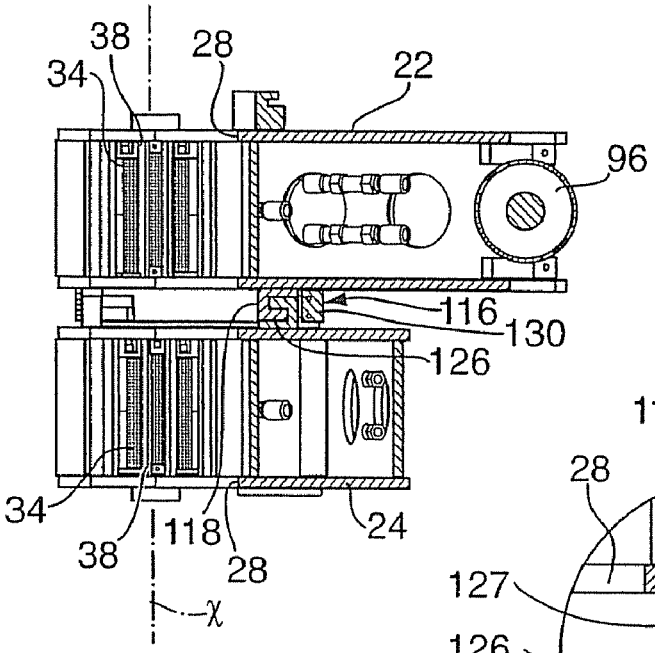
FIG. 3 is a section along lines I-I of FIG. 2B.
Figure 4:
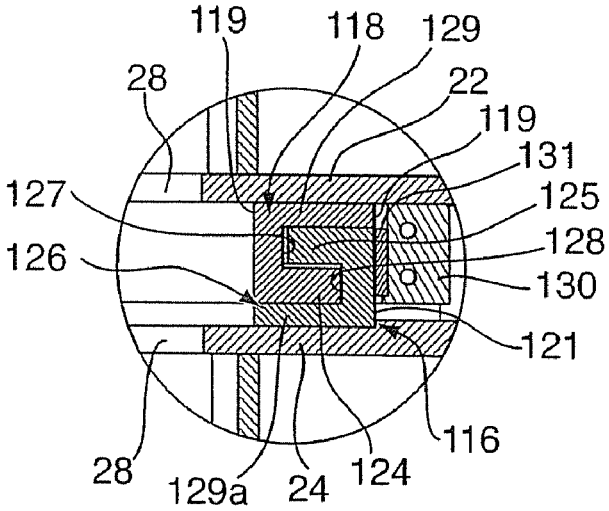
FIG. 4 is an enlarged view of the swivel bearing assembly shown as area B in FIG. 3.

The upper tong 22 may swivel in relation to the lower tong 24 to move the tongs from a neutral position shown in FIGS. 1 and 2A to one of a make up torquing position or a break out torquing position. A make up torquing start position is illustrated in FIG. 2B. To permit the swiveling action, drive system may be provided. One such drive system may include a retractable and extendable linear drive system pivotally connected between the upper tong and the lower tong. In the illustrated embodiment, the linear drive system includes a double acting hydraulic piston and cylinder assembly 96 provided adjacent the end of the tong bodies 26 remote from the die heads 38. Cylinder assembly 96 is attached at its first end to lower tong 24 through a pivot pin 97*a* and bearing assembly and at its opposite end to upper tong 22 through pivot pin 97*b* and a bearing assembly. Cylinder 96 interconnects the upper and lower tongs 22 and 24 so that by extending and retracting the torqueing piston and cylinder assembly 96 in timed relation to extension and retraction of the die heads, the upper and lower tubulars 30 and 31 may be gripped and torqued in a manner to make-up or break apart a threaded connection therebetween.

Extension and retraction of the piston and cylinder assembly 96 will cause the upper and lower tongs 22 and 24 to move toward and away from the torqueing position illustrated in FIG. 2B and into or through the neutral position shown in FIG. 2A. That is, with the upper tong 22 either in alignment with the lower tong 24 or the upper tong 22 moved into angular position with respect to the lower tong 24 which is the torqueing position illustrated in FIG. 2B, the tongs 22 and 24 are moved in a swivelling manner and after gripping the upper tubular and the lower tubular by use of dies, the tubulars may be rotated in relation to each other.

The upper and lower tongs 22 and 24 may be swivelly interconnected by a swivel bearing. In one embodiment for example, the swivel bearing includes a bearing ring assembly 116. Bearing ring assembly 116 may include a first partial ring 118 and a second partial ring 126 spaced outwardly of the recess 28 so that there will be no interference with movement of tubulars through the tongs. In this illustrated embodiment, the first partial ring 118 is secured to the upper tong and the second partial ring 126 is secured to the lower tong 24. Rings 118 and 126 are formed to interlock at interfacing surfaces thereof to provide a swiveling bearing on which the upper tong and lower tong can pivot relative to each other. In the illustrated embodiment, ring 118 includes a peripheral return 124 along its length that creates an elongate groove 127 between the ring base 129 and the return. Ring 126 also includes a peripheral return 125 along its length that creates an elongate groove 128 between the ring base 129*a* and its return. The rings may be formed such that return 124 may be positioned in groove 128 and return 125 may be positioned in groove 127. The interfacing surfaces between the rings, as defined by their returns and grooves, may bear all or some of the forces between the tongs and swivelly orient the upper and lower tongs 22 and 24 so that they will pivot about axis x during their relative pivotal movement. A retainer ring 130 may be provided to retain rings 118, 126 in interlocked arrangement and together with the interlocking arrangement of the rings 118, 126 to provide support in both lateral directions: away from axis x and toward axis x. The retainer ring may be positioned alongside the base of one of first or second rings 118, 126 and opposite the opening of the groove of that ring to react the lateral forces of the tongs during operation. As such, retainer ring 130 holds the returns in their respective grooves. If desired, the retainer ring may be positioned to react a major portion of torque forces between the upper and lower tong as by being in contact with an outer surface of the adjacent first or second ring 118, 126, while clearance is provided between returns 124, 125 and their respective grooves 128, 127. A bearing material layer 131, as by use of an insert, a coating, or by forming the entire ring 130 thereof, may be provided to provide a bearing surface against which the bearing rings may act. The bearing material may be selected to reduce friction and prevent galling, material properties of which are described in greater detail below. In one embodiment, bearing material layer 131 may be formed of material dissimilar to that of the bearing ring against which it acts. In one embodiment, for example, bearing material layer is an insert formed of brass or aluminum, while the bearing rings are formed of steel. The retainer ring may include the insert mounted on a base ring formed of strong material such as steel as the forces against which it must react may be significant.

Since, significant forces are directed though bearing ring assembly 116, galling may occur at some interfacing surfaces, for example, between return 124 and groove 128, between base 129 and return 125 and between return 125 and groove 127. In one embodiment to avoid galling, the rings may be formed of or coated with materials with differing material properties selected to prevent galling therebetween. Materials of differing properties may avoid the material of one ring picking up on the material of the other, with one material being sacrificial to the other. For example, the first ring may be formed entirely of, include an insert of or be coated at its interfacing surfaces with, a material that has at least one of: a different material composition, a different hardness, a different grain structure, etc., than the material forming or coating the interfacing surfaces of the second ring. The rings may be formed entirely of the materials to avoid surface delamination and/or coating wear-through. In one embodiment, at least the interfacing surfaces of the rings may be formed of different materials such as one of steel and the other of brass, aluminum, another steel alloy or composition, etc. In another embodiment, at least the interfacing surfaces of the rings may be formed of materials of different hardness such as one of steel with a first hardness and the other of a similar composition of steel but with a hardness greater than the first hardness, such as for example QT100 and QT130 steels. In the illustrated embodiment, ring 118 on the upper tong is of a material harder than ring 126 on the lower tong. The selection of the softer material for the lower ring may be to facilitate machining of more complex parts. However, either the upper or the lower ring may be selected to be the softer of the two, as desired. In one embodiment the material of one ring is selected to be at least 10% harder, at least 25% harder or possibly at least 50% harder than the material of the other ring. Of course, material selection may be made with consideration as to the useful life of any particular material. Selecting a material that is very soft may permit premature wear and increase maintenance requirements, which may be disadvantageous. Solely for the purpose of example, materials having a Burnell hardness no. (BHN) of between 100 and 370 may be useful for the bearing rings. In one embodiment, one of the rings may have a hardness of BHN 150 to 210 and the other ring may have a hardness of BHN 250 to 310.

When the tongs are properly aligned with oilfield tubulars 30, 31 to be handled, a threaded connection therebetween is positioned between the dies 34 of upper tong 22 and the dies of lower tong 24 and the tubulars extend generally along axis x. In that position, die heads 38 of lower tong 24 may be actuated to grip therebetween lower tubular 31. Then, depending upon whether the threaded connection is being made up or broken apart, the torque piston and cylinder assembly 96 is extended or retracted. During the extension or retraction of the torque cylinder, the die heads 38 on the upper tong 22 will be in their retracted positions so that the upper tong 22 can rotate in relation to the upper tubular 40. Thus, with the upper tong 22 released and the torque piston and cylinder assembly 96 either extended or retracted to an initial position depending upon whether the drill pipe is being made up or broken out, the upper tong 22 may then be brought into gripping engagement with the upper tubular 30 by moving the die heads out to place the dies carried thereon into gripping relation with the tubular. After this has occurred, both the upper tubular 30 and the lower tubular 31 are securely gripped by the respective tongs. Then, the piston and cylinder assembly 96 is actuated for moving the upper and lower tongs 22 and 24 pivotally or swivelly in relation to each other thus torquing the drill pipe joints 30 and 31 either in a clockwise manner or a counterclockwise manner depending upon whether the tubulars are being made up or broken out.

In operation of the torque wrench, spinner 20 is utilized to initially rotate the upper drill pipe joint 30 when making up the drill pipe with the spinner rotating the pipe rather rapidly but at a relatively low torque with the tongs 10 serving to finally tighten the drill pipe joints when making up a drill pipe. Conversely, when breaking out a drill pipe, the tongs 10 initially break apart the connection with the spinner subsequently unthreading the upper tubular 30 from the lower tubular 31 at a relatively high speed and low torque.

Figure 10:
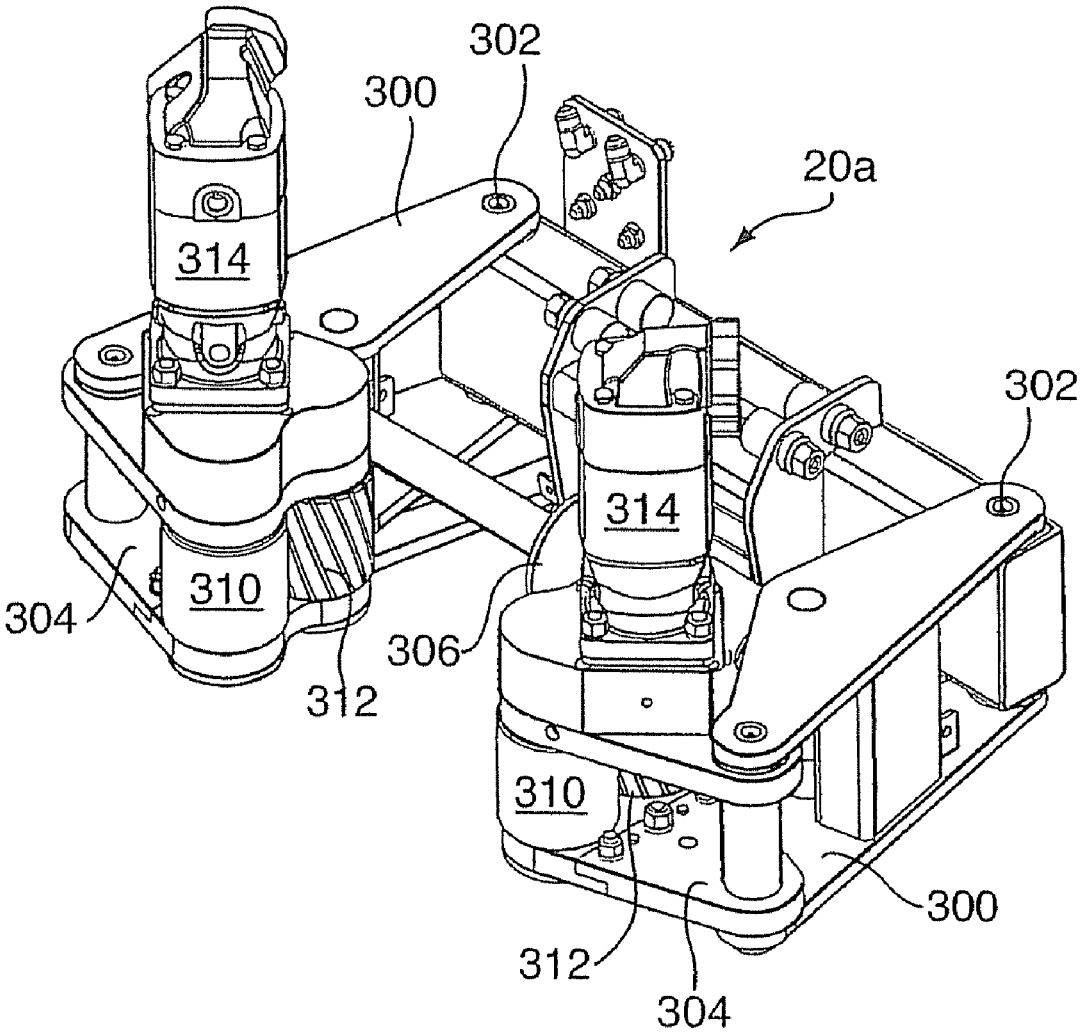
FIG. 10 is a perspective view of a spinner useful in a torque wrench system.

Making reference to FIG. 10, one particular embodiment of a spinner 20 is shown. A pair of pivoted 302 clamp arms 300 is clamped about a tubular to be added to the tubular string during make up, or clamped about the last tubular to be removed from the tubular string during break out. The invention is not limited to a clamp shaped spinner a variety of other spinner configurations may be used.

Engagement between spinner clamp arms 300 and the tubular to be spun includes spinner rollers 310 and 312. Without limiting the invention, the spinner rollers include powered rollers 312 and optionally idlers 310. While FIG. 1A and FIG. 1B show paired powered rollers 312 and idlers 310, the invention is not limited thereto. For example, three powered rollers 312 may be used, two powered rollers 312 with a single idler 310 may be used, as well as any other combination of powered rollers 312 and idlers 310 may be used.

The implementation shown in FIG. 10 includes a powered roller 312 and an idler 310 per clamp arm 300, both mounted on a swivelling clamp arm extension 304. In accordance with the implementation, the rollers 312 and idlers 310 are moved from a neutral position towards axis x to a spinning position engaging tubular 30 via clamping action of the clamp arms 300 powered by a hydraulic or pneumatic piston and cylinder 306. The swivelling clamp arm extensions 304 allow the rollers 312 and idlers 310 to engage different sized tubulars and for a variance in positioning the spinner 20 about tubulars 30. It was found that spinner designs having paired spinner rollers on swivelling clamp arm extensions 304, preserve the alignment of the tubulars achieved by the upper and lower tongs 22 and 24 of the torque wrench 10 within larger tolerance ranges.

During spin in and spin out spinning motion is imparted to the tubular 30 via rollers 312 powered by motors 314. In accordance with a paired spin drive implementation, such a shown in FIG. 1A and FIG. 1B; or in a multiple spin drive implementation (not shown), each powered spin roller 312 imparts spinning torque to the tubular 30, the spinning torque necessary to spin tubular 30 about axis x being divided over the multiple motors 314 and rollers 312 associated therewith reducing load and tear thereon. Advantageously, redundancy is provided should one of the motors 312 fail.

Desirable characteristics of powered rollers 312 include adequate tubular grip, wear resistance and non-vibration inducing; vibration dampening being preferred.

Based on field data, such characteristics may be achieved through engineered roller material properties and surface profiles.

Substantial improvements may be achieved though metallurgy. A softer power roller 312 is beneficial so as not to mar the tubulars 30, however, the softer, the faster the power rollers 312 wear out. Power roller 312 wear leads to vibration. And, smooth power rollers 312 may slip when imparting torque to tubulars 30.

It was found that patterned powered rollers 312 perform better, however not all patterns formed on surfaces thereof improve the overall desirable characteristics. Given the spin speeds used, certain patterns lead to vibration; as grooved patterns wear out, the result may be undesirable vibration.

Spiral/helical patterns having a helical groove angle greater than 10° reduces undesirable vibration. From field data, it was found that increasing overlap improves the desirable characteristics. For the given tubulars and spin speeds typically employed, a desirable helical groove angle range lies about 15 to 35° with one pattern including multiple helical grooves angled about 25° relative to the roller long axis and with adjacent grooves close enough that multiple grooves extend along any section through the length of the roller.

Further improvements in the desirable characteristics may be achieved by engineering the groove geometry, which, without limiting the invention, includes: groove density, groove profile, and the ratio of width vs. depth.

In some torque wrenches, the dies are removable and replaceable to accommodate tubulars with different outer diameters. In one aspect of the present invention, a torque wrench may operate to grip tubulars over a large range of tubular outer diameters, by providing at least one adjustable pipe gripping die mounted in a recess of a torque wrench tong. In particular, each pipe gripping die may include a gripping face defining a plane thereon. The pipe gripping dies along any die head together define an arcuate pipe gripping surface, which may be considered an arc tangentially contacting the planes of the pipe gripping faces. In one embodiment, at least one of the pipe gripping dies on the die head may be automatically adjustable to vary the curvature, for example, a radius, of the arc of the arcuate pipe gripping surface. In one embodiment, the automatically adjustable pipe gripping die is adjustable by force applied against its gripping face. For example, with reference again to FIG. 1A, at least some dies 34 may be formed to be adjustable, as for example, pivotable about an axis substantially in parallel with axis x. As such, dies 34 may pivot to so that their front faces follow the tubular outer curvature when the tubular comes into contact with them. For example, a plurality of dies may pivot inwardly toward each other to a greater degree when handling a small diameter tubular than when handling a tubular with a larger diameter. Dies 34 may be pivotable by use of pivot pins, by forming the die body to rotate in the die head, etc. Of course, it will be appreciated that any pivotally moveable mounting arrangement for the dies must still be capable of accommodating the force under which the torque wrench tong must operate to make up or break out connections of oilfield tubulars. Also, since the angle of applied forces will be tangential relative to the necessary axis of rotation of a die, care may be taken with selection of the die, gripping face and/or its mounting configuration in the die head to ensure that the die is actually capable of gripping a tubular and applying a torque load to it, rather than the die itself, when under load to apply torque, rotating relative to the die head.

Figure 5:
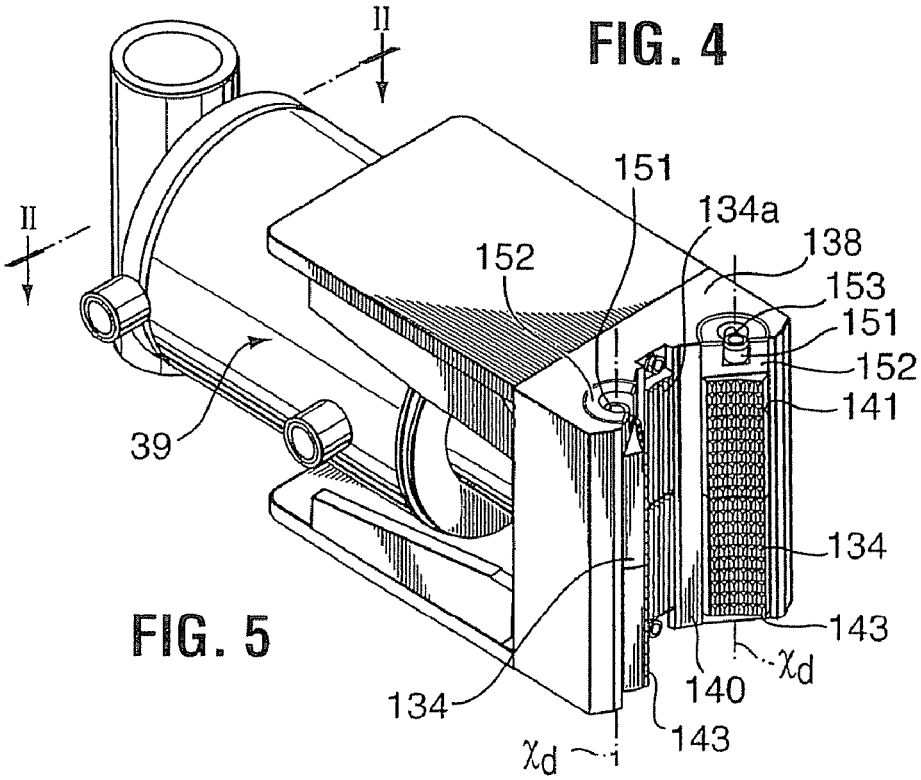
FIG. 5 is a perspective view of an element of a pipe gripping system according to another aspect of the present invention.
Figure 6:
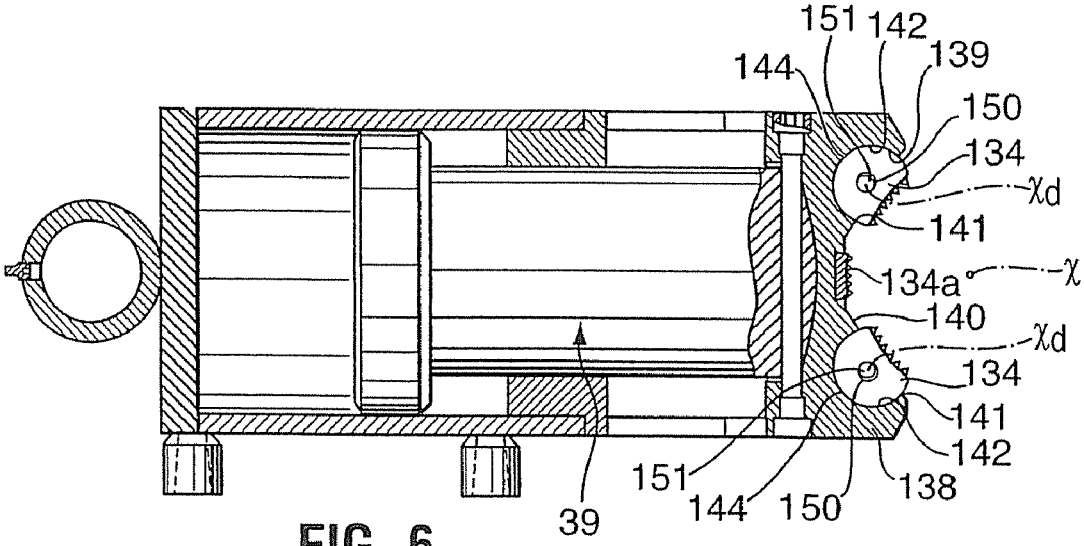
FIG. 6 is a section along lines II-II of FIG. 5.
Figure 7:
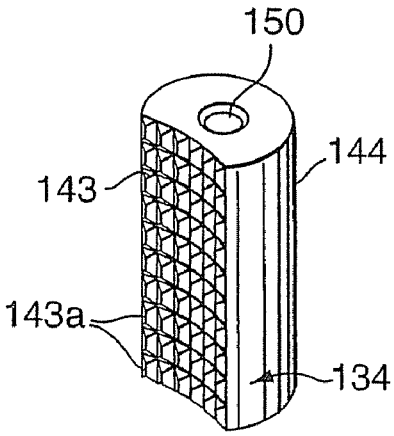
FIG. 7 is a perspective view of a pipe gripping die useful in one aspect of the present invention.
Figure 8:
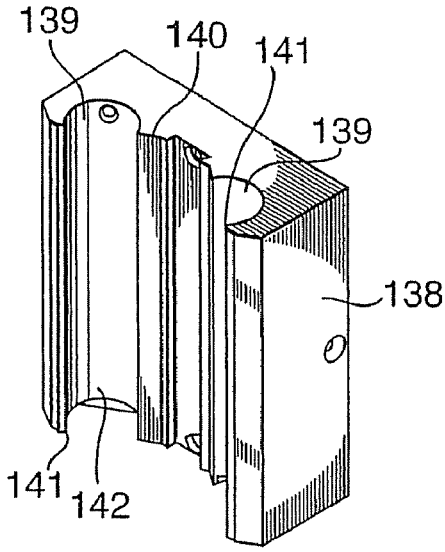
FIG. 8 is a perspective view of a die head useful in one aspect of the present invention.

With reference to FIGS. 5 to 7, in one embodiment, dies 134 may be formed to accommodate pivotal movement relative to the die head by forming the dies and their mounting position in die head 138 to permit such pivotal movement. For example, in the illustrated embodiment, die head 138 includes a pocket 139 opening on its front face 140 for accepting and retaining a die 134. Pocket 139 opens at an opening 141 in front face 140 and extends back therefrom to define a generally cylindrical back wall 142 with an axis of curvature generally parallel to axis x, which is the axis at which in operation the long axis of an oilfield tubular is intended to extend past the die head. A die 134 for mounting in pocket 139 includes a body formed to be positioned in pocket and rotate therein along an axis of rotation xd generally parallel to axis x. In the illustrated embodiment, die 134 is formed to define a front surface 143 including gripping teeth 143*a* thereon selected to grip the tubular to be handled by the tong and a rear surface 144 diametrically opposite the front surface. Rear surface 144 may be formed to define a curvature at least about axis xd that corresponds with the curvature of the pocket's back wall 142. For example, the die and the pocket may be formed and assembled such that the die, and in particular, rear surface 144 of die can be supported against back wall 142 of the pocket so that any load applied to front face 143 can be transferred through the die rear surface to the pocket back wall 142, which is either formed from or intimately in contact with die head 138. In one embodiment, the die body is generally cylindrical and back wall of pocket includes a substantially mating cylindrical curvature.

Care may be taken in the mounting of a pivotally moveable die to discourage the die from rotating on the die head to a position where teeth 143*a* are no longer exposed on the front face. As such, dies and/or pockets may include rotation limiters to limit the degree of rotation of a die in its pocket. Rotation limiters may be provided by shoulders, stops, selection of body curvature of dies or pocket walls, etc. In the illustrated embodiment, die 138 includes off-center apertures 150 in its upper and lower ends and pins 151 extending into pockets 139 to loosely engage in apertures 150 and positioned to bind against the aperture should the die rotate beyond a selected range relative to opening 141 of the pocket. Apertures 150 may be off-center relative to the die's axis of rotation xd and have a diameter larger than that of the pins 151. Pins 151 may extend from die head 138 or, as shown, from a part mounted to die head and may be substantially aligned along the axis of rotation xd. In this illustrated embodiment, pins 151 are each mounted on a die retainer 152 secured by a fastener 153 to die head 138. The relative positioning of apertures 150 and pins 151, and the loose engagement of the pins in their respective apertures, permit rotation of die 134 in its pocket but limit such rotation when the pin binds against the side walls defining the apertures. Pins 151 may also act to hold the dies against falling out of their pockets. Of course, other rotation limiters may be used. For example, using the above-noted illustrated embodiment alone as a reference, the pins may be mounted on the dies and the apertures may be formed on the pockets and the off-center positioning may be applied to the pins, while the apertures may be placed on center of the axis xd.

In the illustrated embodiment, die 134 is formed with consideration to its front face 143 and axis of rotation xd to avoid rotation of the dies when acting to apply a torque load to a tubular being handled. For example, front face 143 may be generally concave along its length such that the teeth 143*a* formed thereon may fit more closely against the cylindrical outer surface of a tubular to be handled.

If desired, a fixed die 134*a* may be positioned on die head 138 between adjustable dies 134. The fixed die may be useful for gripping a tubular with a diameter smaller than one that may be gripped effectively by dies 134.

In one embodiment, as shown, dies 134, 134*a* may be formed of an upper part separable from a lower part, so that the length of the gripping face may be varied. This may be useful when the tubular being handled includes hardfacing, a stepped or otherwise varying surface such that tubular gripping may be effected through a short surface area. In such a situation, a blank (non-toothed) die part may be replaced for the upper or lower part such that gripping is avoided in that region.

In use of torque wrenches for making up/breaking out oilfield tubulars, it is desired that the torque wrench operate close, but not beyond, physical material limits of the tubulars, the rig, the torque wrench and the torque wrench dies. However, such physical material limits are difficult to predict and typically vary with environmental parameters. In one situation for example, it is desired that the torque wrench be operated below a condition where the dies slip on the tubular being handled. Die slippage may be indicative of worn dies, or other problems. In any event, die slippage may cause damage to the tubulars being handled and may damage torque wrench and rig components, especially if the dies of the lower tong slip. In one embodiment, therefore, it is desired that die slippage be detected so as not to run the torque wrench without adequate grip on the tubulars.

In one embodiment, software torque detection may be used employing high speed monitoring of the torque curve. In such a method for detection, the torque curve may be monitored wherein the normal trend during connection is for the torque to trend up generally linearly over time. However, die slipping may be detected wherein the torque curve flattens. Such an approach requires high speed data collection and monitoring.

Figure 9:
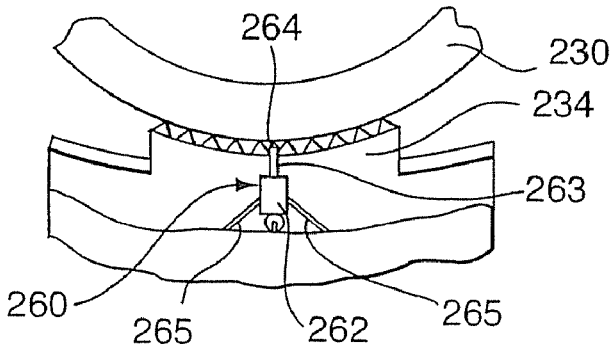
FIG. 9 is a top plan view of a portion of a pipe gripping system according to another aspect of the present invention.

With reference to FIG. 9, in another embodiment, a probe 260 is provided in or adjacent a die 234 and may be selected to detect lateral, slippage movement between a tubular 230 being handled and die 234, when the die is in a gripping position against the tubular. Probe 260 may be positioned to contact the tubular being handled, when the tubular is gripped by the die, and in one embodiment may be selected to detect bend in the probe as would be caused by slippage of the tubular relative to the die, and therefore the probe, after the probe was in contact with the tubular.

In the illustrated embodiment of FIG. 9, which shows only one possible embodiment, probe 260 includes a cylinder 262, for example, using hydraulics, including a rod 263 that may be extended into contact with the tubular or retracted to avoid damage thereto when not of use. Rod 263 may include a hardened tip 264 for contacting or possibly biting into, as by use of carbide, the outer surface of a tubular being handled. Probe 260 may further include one or more sensors 265 positioned to detect deflection of the cylinder or the rod, such sensors communicating any detected deflection to a torque wrench monitoring or control system so that appropriate action may be taken to avoid further slippage.

Of course, a probe for detecting die slippage may employ other solutions such as for example, strain gauges, framework bend sensors, piezoelectric sensors, etc.

Although various aspects of the present invention have been described herein including for example a swivel bearing ring assembly, an adjustable die arrangement, a die slippage indicator, a redundant spin driver, and engineered powered spin rollers, it is to be understood that each of these features may be used independently or in various combinations, as desired, in a torque wrench.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. An oilfield tubular torque wrench comprising:

an upper tong including a recess for accepting an oilfield tubular positioned along an axis passing through the recess;

a lower tong including a recess positioned below the recess of the upper tong so that the axis passes therethrough;

pipe gripping dies in the recesses of the upper tong and the lower tong drivable toward and away from the axis; and a swivel bearing between the upper tong and the lower tong permitting the upper tong and the lower tong to swivel relative thereto while the recesses remain positioned with the axis passing therethrough, the swivel bearing including a first partial ring mounted to one of the upper tong and the lower tong and a second partial ring mounted on the other of the upper tong and lower tong, the second partial ring being interengaged at a bearing surface to ride along a length of a bearing surface of the first partial ring and the bearing surface of the second partial ring being formed of a material different than the material of the bearing surface of the first partial ring.

2. The oilfield tubular torque wrench of claim 1, wherein the bearing surface of the second partial ring is formed of a material harder than the material of the bearing surface of the first partial ring.

3. The oilfield tubular torque wrench of claim 2, wherein the material hardness of the bearing surface of the second partial ring is at least 10% harder than the material hardness of the bearing surface of the first partial ring.

4. The oilfield tubular torque wrench of claim 1, wherein the swivel bearing includes a retainer ring positioned adjacent one of the first partial ring and the second partial ring to act against lateral disengagement of the second partial ring from the first partial ring.

5. The oilfield tubular torque wrench of claim 4, wherein the swivel bearing includes a bearing interface between the retainer ring and at least one of the first partial ring and the second partial ring.

6. The oilfield tubular torque wrench of claim 1, wherein at least one of the bearing surfaces of the first or second partial rings is a coating layer of a material that is different than the material of the bearing surface of the other partial ring.

7. The oilfield tubular torque wrench of claim 1, wherein at least one of the bearing surfaces of the first or second partial rings comprises an insert of a material that is different than the material of the bearing surface of the other partial ring.

8. The oilfield tubular torque wrench of claim 1, wherein the material of the bearing surface of the second partial ring has a different hardness than the material of the bearing surface of the first partial ring.

9. The oilfield tubular torque wrench of claim 1, wherein the material of the bearing surface of the second partial ring has a different grain structure than the material of the bearing surface of the first partial ring.

10. The oilfield tubular torque wrench of claim 1, wherein the material of the bearing surface of the second partial ring has a different material composition than the material of the bearing surface of the first partial ring.

11. The oilfield tubular torque wrench of claim 1, wherein the materials of the bearing surface of the first and second partial rings have at least two of the following differences: hardness, grain structure, and material composition.

12. The oilfield tubular torque wrench of claim 1, wherein at least one of the pipe gripping dies is automatically adjustable by a pivotal connection mounting the at least one pipe gripping die in the recess; and further comprising a rotation limiter to limit the range of rotational movement of the at least one of the pipe gripping dies about the pivotal connection mounting.

13. The oilfield tubular torque wrench of claim 1, wherein at least one of the pipe gripping dies further comprises a concave front face portion to facilitate a closer fit of the teeth against the outer surface of a tubular.

14. The oilfield tubular torque wrench of claim 1, further comprising a sensor to detect slippage between the pipe gripping dies and the oilfield tubular.

15. The oilfield tubular torque wrench of claim 1, further comprising a patterned power roller, wherein the pattern includes a helical groove with an angle ranging from approximately 15 degrees to approximately 35 degrees.

16. An oilfield tubular torque wrench tong comprising:

a recess for accepting an oilfield tubular along an axis passing through the recess; and pipe gripping dies mounted in the recess, each pipe gripping die including a gripping face defining a plane thereon and the pipe gripping dies together defining an arcuate pipe gripping surface including an arc tangentially contacting the planes of the pipe gripping faces, at least one of the pipe gripping dies being automatically adjustable to vary a radius of the arc of the arcuate pipe gripping surface, wherein the tong is operably coupled through a swivel bearing to a second tong, thereby permitting swivel action of the tong and the second tong relative to each other while the recess remains positioned along the axis, the swivel bearing including a first partial ring mounted to one of the upper tong and the lower tong and a second partial ring mounted on the other of the upper tong and lower tong, the second partial ring being interengaged at a bearing surface to ride along a length of a bearing surface of the first partial ring and the bearing surface of the second partial ring being formed of a material different than the material of the bearing surface of the first partial ring;

wherein at least one of the pipe gripping dies further comprises a concave front face portion to facilitate a closer fit of the teeth against the outer surface of a tubular.

17. The oilfield tubular torque wrench tong of claim 16, wherein the at least one pipe gripping die being automatically adjustable by force applied against its gripping face.

18. The oilfield tubular torque wrench tong of claim 16, wherein the at least one pipe gripping die is automatically adjustable by a pivotal connection mounting the at least one pipe gripping die in the recess.

19. The oilfield tubular torque wrench tong of claim 18, further comprising a rotation limiter to limit the range of rotational movement of the pipe gripping die about the pivotal connection mounting.

20. The oilfield tubular torque wrench tong of claim 16, further comprising a pocket for accepting the mounting of the at least one die in the recess, the pocket including a curved rear wall opposite an opening to the recess and wherein the at least one pipe gripping die includes a curved body capable of rotating within the pocket.

21. An oilfield tubular torque wrench comprising:

an upper tong including a recess for accepting an oilfield tubular positioned along an axis passing through the recess;

a lower tong including a recess positioned below the recess of the upper tong so that the axis passes therethrough;

pipe gripping dies in the recesses of the upper tong and the lower tong drivable toward and away from the axis;

a swivel bearing between the upper tong and the lower tong permitting the upper tong and the lower tong to swivel relative thereto while the recesses remain positioned with the axis passing therethrough, the swivel bearing including a first partial ring mounted to one of the upper tong and the lower tong and a second partial ring mounted on the other of the upper tong and lower tong, the second partial ring being interengaged at a bearing surface to ride along a length of a bearing surface of the first partial ring; and a retainer ring positioned adjacent one of the first partial ring and the second partial ring to act against lateral disengagement of the second partial ring.

22. The oilfield tubular torque wrench of claim 21, wherein the swivel bearing includes a bearing interface between the retainer ring and at least one of the first partial ring and the second partial ring.

23. The oilfield tubular torque wrench of claim 22, wherein the bearing surface of the second partial ring comprises a material different than the material of the first partial ring.

24. The oilfield tubular torque wrench of claim 21, wherein the retainer ring is positioned to react lateral force from torquing the upper tong and the lower tong relative to each other about the swivel bearing.

25. The oilfield tubular torque wrench of claim 21, wherein at least one of the pipe gripping dies are automatically adjustable by a pivotal connection mounting the at least one pipe gripping die in the recess and further comprising a rotation limiter to limit the range of rotational movement of the at least one of the pipe gripping dies about the pivotal connection mounting.

26. The oilfield tubular torque wrench of claim 21, wherein at least one of the pipe gripping dies further comprises a concave front face portion to facilitate a closer fit of the teeth against the outer surface of a tubular.

27. An oilfield tubular torque wrench comprising:

an upper tong including a recess for accepting an oilfield tubular positioned along an axis passing through the recess;

a lower tong including a recess positioned below the recess of the upper tong so that the axis passes therethrough;

pipe gripping dies in the recesses of the upper tong and the lower tong drivable toward and away from the axis;

a swivel bearing between the upper tong and the lower tong permitting the upper tong and the lower tong to swivel relative thereto while the recesses remain positioned with the axis passing therethrough, the swivel bearing including a first partial ring mounted to one of the upper tong and the lower tong and a second partial ring mounted on the other of the upper tong and lower tong, the second partial ring being interengaged at a bearing surface to ride along a length of a bearing surface of the first partial ring, wherein the swivel bearing includes a bearing interface between the retainer ring and at least one of the first partial ring and the second partial ring; and a retainer ring positioned adjacent one of the first partial ring and the second partial ring to act against lateral disengagement of the second partial ring wherein the bearing interface includes a brass material surface.

28. The oilfield tubular torque wrench of claim 27, wherein a lateral clearance is provided between the first partial ring and the second partial ring.

* * * * *